United States Patent [19]

Lin

[11] Patent Number: 4,729,585

[45] Date of Patent: Mar. 8, 1988

[54] TRUMPET DOOR LOCK WITH AN ADJUSTABLE DEAD BOLT

[76] Inventor: Jui C. Lin, 297, Bor Ay Road, Kaohsiung, Taiwan, Taiwan, 800

[21] Appl. No.: 836,431

[22] Filed: Mar. 5, 1986

[51] Int. Cl.[4] ..... E05C 1/16

[52] U.S. Cl. ..... 292/337; 292/DIG. 60; 292/169.13

[58] Field of Search ..... 292/337, DIG. 60, 169.13

[56] References Cited

U.S. PATENT DOCUMENTS 4,372,594 2/1983 Gater ..... 292/DIG. 60 X

*Primary Examiner*—Richard E. Moore

*Attorney, Agent, or Firm*—Holman & Stern

[57] ABSTRACT

A trumpet lock has an extending shell and a rotating shell which are disposed about a cylinder. The rotating shell and extending shell can be manipulated by a projection-and-slot arrangement into two positions, namely a short position and a long position. The trumpet lock has a dead bolt and an anti-burglar bolt which are linked by a guarding plate, linking-plate, pulling plate, and extending plate. When a door is closed, the anti-burglar bolt is pushed into the shell and remains there so as to prevent entry of the dead bolt into the shell by the obstruction of the guarding plate against the rear portion of the dead bolt.

5 Claims, 20 Drawing Figures

TRUMPET DOOR LOCK WITH AN ADJUSTABLE DEAD BOLT

BACKGROUND OF THE INVENTION

Door locks, in order to meet different size requirements, are manufactured in different sizes to accomodate the width of the frame post in a door. When a lock is to be fixed in a door, a hole for fitting it in has to be cut into the door at an appropriate distance from the edge of the door. Lock manufacturers have to prepare different molds for making different sizes of locks, and retailers, in order to serve such a variety for consumers, are obliged to devote more shelf space for storing them. Moreover, the consumer must as well have specific knowledge about the size of the locks should they want to buy locks of correct size.

SUMMARY OF THE INVENTION

A trumpet door lock according to the present invention possesses a dead bolt which is to extend out from the side surface of the door, and which is operated by a knob. The distance that the dead bolt extends outwards or inwards is constant. The distance between the dead bolt and the knob must be a little longer than the width of the frame post of the door, therefore the width of the frame post of the door must be known before the correct position of the hole in the door for receiving the knob is formed. The present invention is an adjustable dead lock, having an extending shell and a rotating shell. The lock has a cylinder on its base. The cylinder is attached with projections to guide a rotating shell and an extending shelling moving along slots on them and to position them. The distance between the locking base riveted on the bottom of the extending shell and the dead bolt is dependent on the extension of the extending shell.

DETAILED DESCRIPTION OF THE INVENTION

Figure 1:
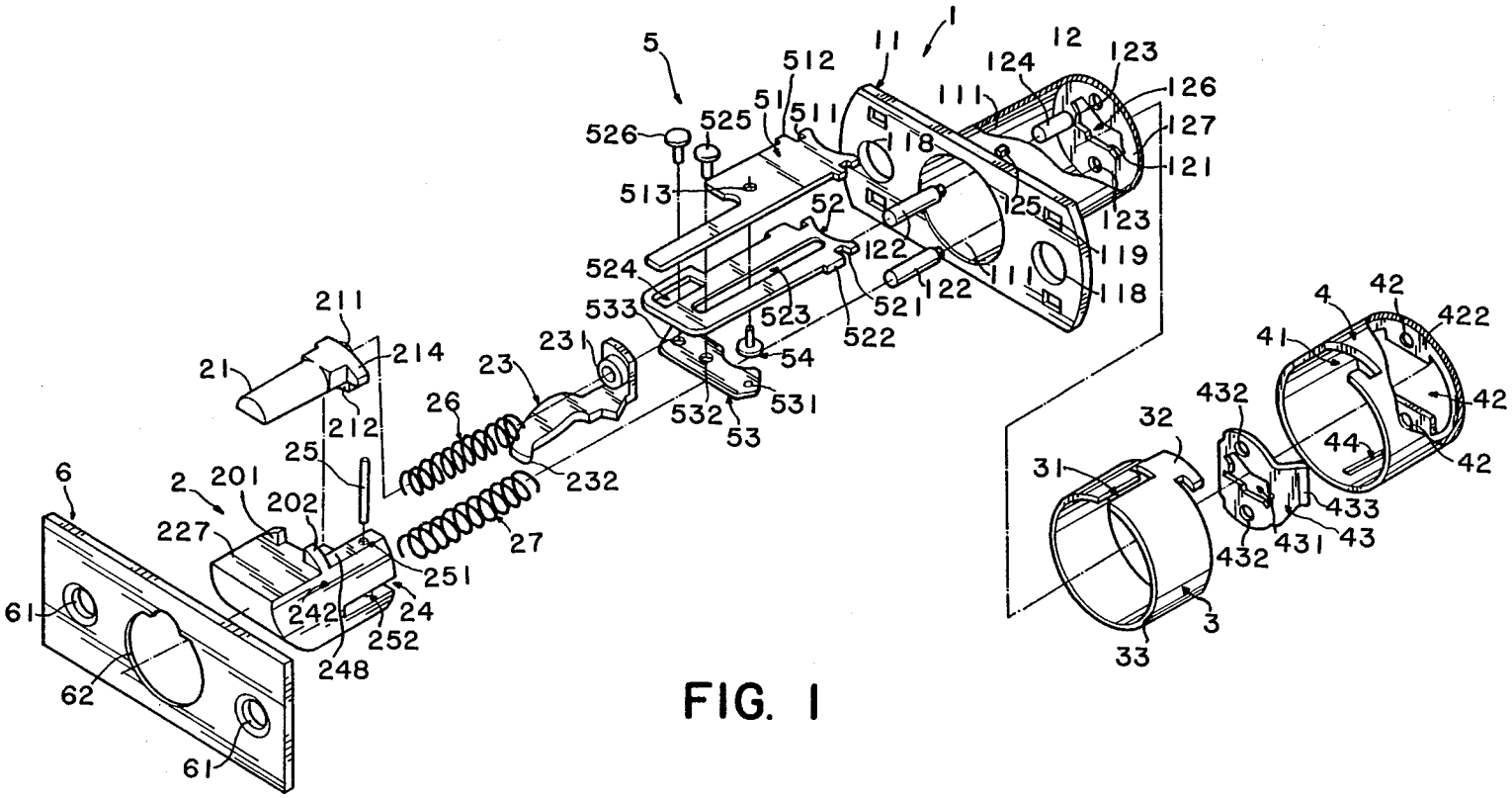
FIG. 1 is an assembly view of the parts of the door lock with an adjustable dead bolt of the present invention.

FIG. 1, which is an assembly view of the present invention, shows a face plate 6, dead bolt 2, anti-burglar lock 21, and guarding plate 23 which are to be assembled together. The anti-burglar lock 21 is slideable between the projections 201,202 of the dead bolt 2, with the lower-most surface of the anti-burglar lock 21 riding upon the uppermost surface 227 of the dead bolt 2. The guarding plate 23 is a resiliently deformable member composed of flexible metal, flexible plastic, flexible rubber, or the like material. A spring 27 is received within an aperture (not shown in FIG. 1) of the dead bolt 2, the spring 27 riding upon a lower cylinder 122 which is to be fastened to the end of the cylinder 12. The spring 26 is received about the projection 231 of the guarding plate 23 at one end thereof, the other end of the spring 26 being disposed about a projection 211 on the anti-burglar lock 21.

Also seen in FIG. 1 is an extending plate 51, a pulling plate 52, and a linking plate 53. A rivet 526 is assembled into the aperture 524 of pulling plate 52 and aperture 533 of linking plate 53. Aperture 531 of linking plate 53 is connected to the dead bolt 2 by pin 25 which passes through aperture 251 and 252 of the dead bolt 2, with the aperture 531 of the linking plate 53 being disposed within the slot 24 of the dead bolt 2 to also receive the pin 25. A rivet 54 is received within a slot 523 of the pulling plate 52, and is received within the aperture 513 of the extending plate 51.

The extending plate 51 has an end 514 which projects through an aperture 26 formed in the end wall of the cylinder 12. Likewise, the pulling plate 52 has an end 525 which is also received by the aperture 126 of the cylinder 12.

The cylinder 12 has a fixing plate 11 having an aperture 111 for receiving the assembly of components designated 5 as well as the dead bolt 2, the anti-burglar lock 21, and the other components connected thereto. The fixing plate 11 also has a plurality of apertures 118,119 for attachment of the fixing plate 11 to a door. The cylinder 12 has a pair of apertures 123, 123 formed in the rear wall 127 for receiving portions of the pins 122, 122. As seen in FIG. 1, the exterior of that cylinder 12 is partially broken away, to reveal the interior end wall features. On the exterior of the cylinder 12 is a projection 125.

The cylinder 12 is received within a rotating shell 3 as well as an extending shell 4. The rotating shell 3 and extending shell 4 are connected to one another by the projection 32 of the rotating shell 3. The rotating shell 3 has a slot therein for receiving the projection 125 of the cylinder 12.

A face plate 6, having apertures 61, 62 therein, is for connection by a fastener (not shown) to the apertures 118,118 of the fixing plate 11. The aperture 62 is adapted to receive therethrough the dead bolt 2 and the anti-burglar lock 21, The face plate 6, dead bolt 2, anti-burglar lock 21, and fixing plate 11 are all preferably composed of a strong material such as metal, including steel, brass, or the like. Alternatively, any or all of the parts of the present invention can be composed of any material including metal, plastics, or the like, which is sufficiently strong to permit the intended use of the parts, namely to provide a secure closure for a door or the like.

The extending shell 4 has a pair of projections 42,42 formed in an end wall 422. The apertures 42,42 match with respective apertures 432,432 of a plate 43. The plate 43 has a pair of arms 433,433 (only one of which is visible in FIG. 1) which project through the aperture 421 of the extending shell 4. The extending shell 4 has an aperture which is L-shaped, receiving the L-shaped projection 32 of the rotating shell 3. The rotating shell 3 has a front surface 33 which is adapted to abut the projection 125 of the cylinder 12 in one position and to receive the projection 125 of the cylinder 12 within the slot 31, which is also L-shaped in a second position of the shell 3 about the cylinder 12.

Figure 7:
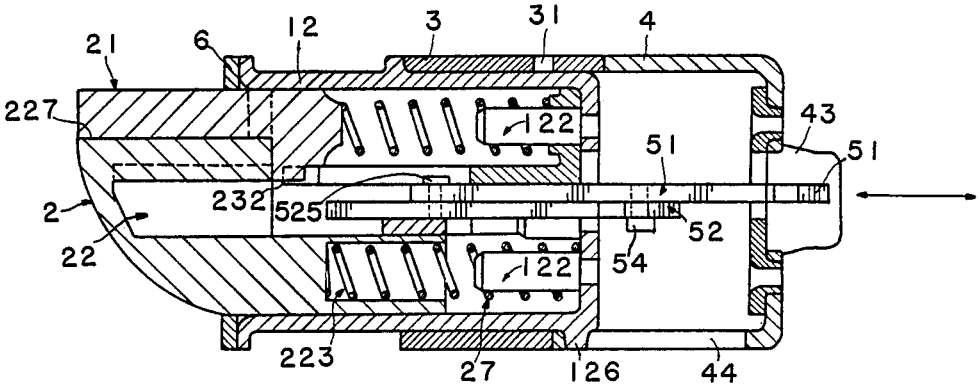
FIG. 7 is a side cross-sectional view of the door lock adjusted to a long size and not locked in the present invention.

The extending shell 4 has a slot 44 therein adapted to receive a projection 126 therein. The projection 126 projects from the lowermost portion of the cylinder 12 for guiding the shell 4 relative to the cylinder 12, as seen in FIGS. 1 and 7.

Figure 2:
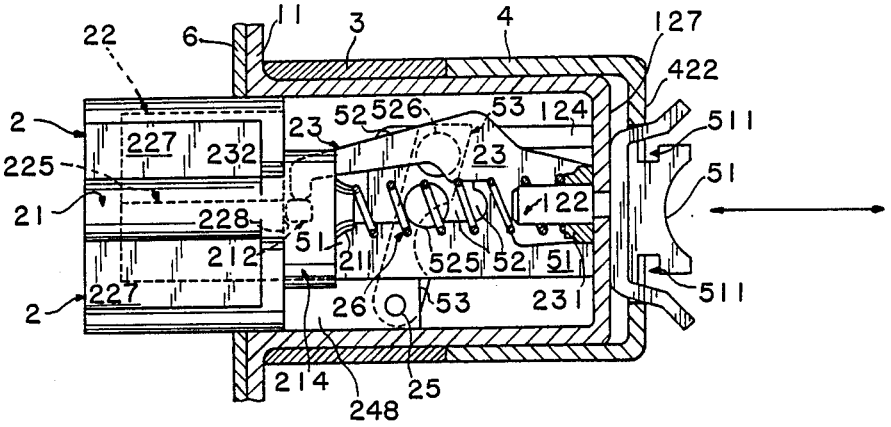
FIG. 2 is a top view, partly in section, of the dead bolt protruding out but not locked in the present invention.

FIG. 2 is a top elevational view, partially in section, of the assembled trumpet lock of FIG. 1. Here, the dead bolt 2 and the anti-burglar bolt 21 project through the face plate 6 and through the fixing plate 11. The shells 3 and 4, as well as the plates 6 and 11, are shown in sectional view, with the remaining parts all shown in elevational view with the exception of the base 231 of the guarding plate 23, which is partially broken away to show its section. The anti-burglar lock 21 overlies a tip 232 of the guarding plate 23. The tip 232 abuts a projection 212 (shown in dotted outline in FIG. 2), in abutting and sliding contact therewith. In the position of the tip 32 shown in FIG. 2, any sliding motion of the dead bolt 2 to the right of FIG. 2 relative to the cylinder 12 would result in entry of the tip 32 into a hole 22 (shown in dotted outline in FIG. 2; shown in detail in FIGS. 17–19). In the position of the tip 232 shown in FIG. 2, the tip just misses a portion of the end wall 228 of the dead bolt 2. The end wall 282, shown more clearly in FIG. 17–19, has a irregular upper surface which is high enough to recieve the tip 232 in the position of FIG. 2, but which drops downward at the location shown by dotted line 225 in the figure. This, a the location 225 the hole 22 is reduced in size such that the end wall 228 would obstruct tip 232 at any location below the line 225, while permitting entry of the tip 232 into the hole 22 when the tip 232 is at a location just above the line 225.

Also as seen in FIG. 2, the plate 43 projects through the end wall of the shell 4. The plate 43 is fixedly connected to the rear wall 422 of the shell 44 (attachments not shown in these figures) via the corresponding apertures 432 and 42. The plate 43 is not fixedly connected to the cylinder 12, but can move away from the cylinder 12 in an extended position of the shell 4.

As seen in FIG. 2, the arm 242 of the dead bolt 2 is connected by pin 25 to the linking plate 53. The guarding plate 23 is fixedly connected to the end wall 127 of the cylinder 12 by the pin 122 which is connected to the end wall 127 fixedly, as by riveting, welding, or the like. The spring 26 biases the anti-burglar lock 21 away from the pin 122. The other end of the spring 26 is disposed about the projection 211 of the anti-burglar bolt 21. The extending plate 51 is seen in FIG. 2 underlying the guarding plate 23. Rivets 525 and 526 are also shown in FIG. 2, and the pulling plate 52 is seen underlying the extending plate 51 while overlying the linking plate 53.

Figure 3:
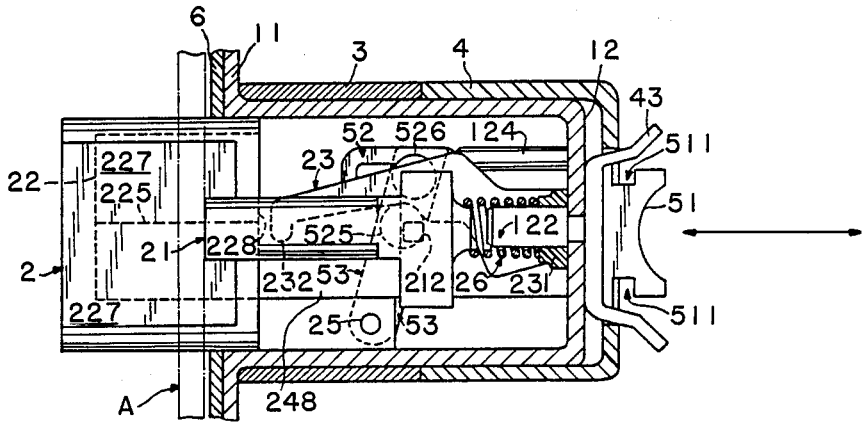
FIG. 3 is a top view, partly in section, of the dead bolt locked in the present invention.

FIG. 3 is the position of the parts of FIG. 2 when the dead bolt 2 has been received within a snugly-fitting recess in a door such that the door prevents entry of the anti-burglar lock 21 into the recess of the door frame. The door frame has a wall "A" indicated in FIG. 3, the wall "A" being preferably a cover-plate, such as is conventional in door frames, to cover an opening formed in the door frame which receives the dead bolt 2). The dead bolt 2 and anti-burglar lock 21 are moved into the cylinder 12 by movement of the door which supports the cylinder 12; in FIG. 1, the parts are shown in a "sideways" position, which is generally horizontally disposed. This assembly, if rotated 90 degrees, would then lie in a vertical plane which is more customarily associated with doors. The lower curved surface of the dead bolt 2 permits sliding engagement of the dead bolt 2 with the frame plate "A" and permits sliding engagement with the frame itself (not shown in the drawings). Such actuation of the dead bolt 2 inwardly into the cylinder 12 is well-known in the art and is conventional. As can be seen from FIGS. 1–3, movement of the deadbolt 2 inwardly by coaction of the moving door relative to the fixed frame (the frame is not shown) results in movement of the anti-burglar lock 21 with the deadbolt 2 due to the projection 201,202 of the dead bolt 2 which coact with respective projections 213,214 of the anti-burglar lock 21. Thus, movement of the dead bolt 2 into the cylinder 12 causes the anti-burglar lock to move therewith. However, as seen from FIG. 3 and the following figures, entry of the dead bolt 2 to the apertures formed in the frame plate "A" does not require movement of the anti-burglar lock 21 therewith, rather the frame plate "A" prevents entry or passage therethrough of the anti-burglar lock 21. Such a frame plate construction as indicated by the frame plate "A" is also conventional and well-known. As shown in FIG. 3, the frame plate "A" has received the dead bolt 2 therethrough, and has obstructed passage of the anti-burglar lock 21. In this position, the projection 212 of the anti-burglar bolt 21 has moved to the right as compared to FIG. 2. Movement of the projection 212 has permitted the tip 232 of the guarding plate 23 to return to its undeformed position so that the tip 232 extends below the dotted line 225 and into a position where the downwardly-extended portion of the wall 228 would obstruct entry of the tip 232 into the recess 22. FIG. 3 thus corresponds to a blocked position of the dead bolt 2, the dead bolt 2 being blocked by the tip 232 of the guarding plate 23 which has resiliently returned to its original position. The movement of the guarding plate 23, into either resiliently deformed or resiliently undeformed condition, is caused by the action of the head of the rivet 525, shown in dotted outline in FIG. 3. The sequence of movement of the guarding plate 23 is shown clearly in FIG. 4B, described hereunder.

Figure 4A:
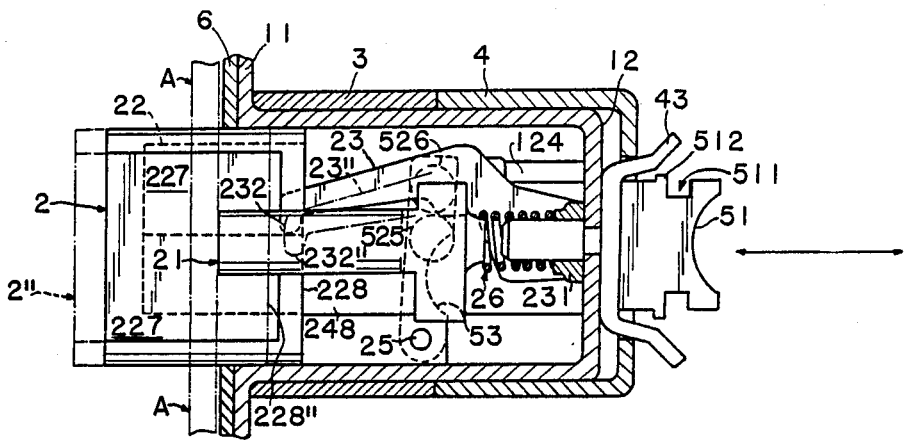
FIG. 4A is a top view, partly in section, of the dead bolt to be unlocked in the present invention.

FIG. 4A shows the rivet 525 in engagement with the guarding plate 523 to cause deformation of the guarding plate 23 from the position 232" to the position 232. This corresponds to the movement of the dead bolt 2 (indicated in dotted outline in FIG. 4A) to the position indicated as dead bolt 2 (shown in solid outline in the figure). As seen in FIG. 4A, in the position indicated in solid outline of the dead bolt 2, the tip 232 has penetrated into the recess 22, while in the dotted outline positions of the dead bolt 2 and the tip 232, the tip 232 abuts the rear wall 228" shown in the figure.

Figure 4B:
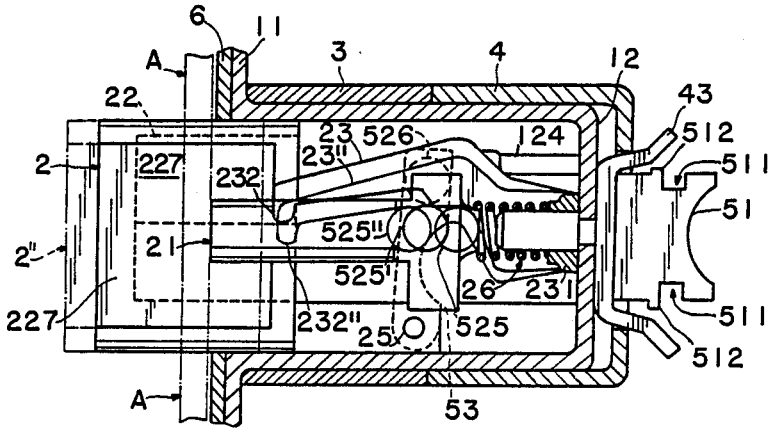
FIG. 4B is s top view of the dead bolt of FIG. 4A, showing three positions of a rivet actuating a guarding plate.

FIG. 4B shows a view similar to that shown in FIG. 4A, with three positions of the rivet head 525 being shown, the initial position being indicated as rivet head 525", and the end position of the rivet head 525 being indicated at the rightmost portion, with an intermediate position of the rivet head being indicated as rivet head 525', located in between the other two positions. The position of the rivet head indicated a 525 is the final position which coresponds to the upper position 23 of the guarding plate. The lower position of the guarding plate is indicated at 23", and corresponds to a position when the rivet head 525" abuts the curved lower surface of the guarding plate 23". The rivet head 525 is actuated by retraction of the pulling plate 52 so that, when the end of the slot 523 in the pulling plate 52 is reached, the end of the slot 523 forces the rivet head 525 to move therewith. Thus, the end of the pulling plate 521, or in the extended position when the end of the extending plate 51, is operatively connected to a door knob, door latch, handle, or other operator which causes movement of the pulling plate 52 or of the exending plate 51 in the direction indicated by the double-headed arrow in FIGS. 4A and 4B.

Figure 5:
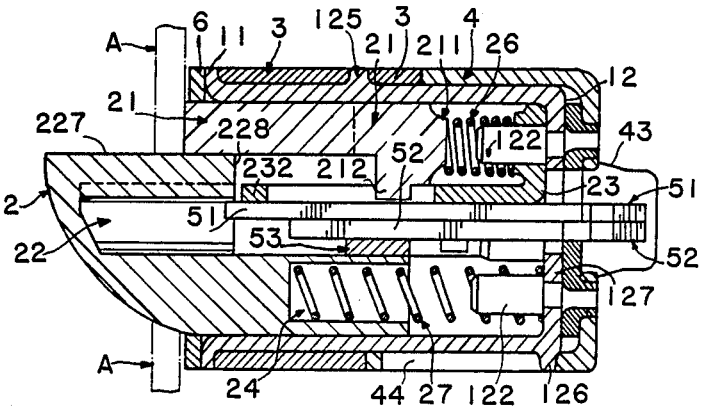
FIG. 5 is a side section view of the dead bolt locked in the present invention, and corresponds to the dead bolt position of FIG. 4A.

FIG. 5 is a side-sectional view, partly in elevation, taken along line 5—5 of FIG. 4A. In FIG. 5 it can clearly be seen the obstructing effect of the tip 232 against the wall 228 of the dead bolt 2. The dotted line 221 in FIG. 5 corresponds to the enlargement of the recess 22 below the plane of the figure. In the position shown in FIG. 5, the tip 232 of the guarding plate 23 is in obstructing position to the dead bolt 2 since the tip 232 cannot be received within the recess 22. Here, the anti-burglar bolt 21 is shown as is the downwardly extending projection 212 which abuts the guarding plate 23 in this figure. FIG. 5 shows the lower spring 27 in position received within the slot 24, one end of the spring 27 being received about the lower sleeve 122. The lower sleeve 122 is also fixedly connected to the rear wall 127 of the cylinder 12. The upper spring 26 is compressed, and the obstructing effect of the frame plate "A" is clearly evident in FIG. 5.

Also seen in FIG. 5 is the projection 125 of the cylinder 12 which has extended into a portion of the slot 31 of the shell 3. Here, it is also clearly seen that the linking plate 53 underlies the pulling plate 52 which in turn underlies the extending plate 51. The extending plate 51 in turn underlies the guarding plate 232.

Figure 6:
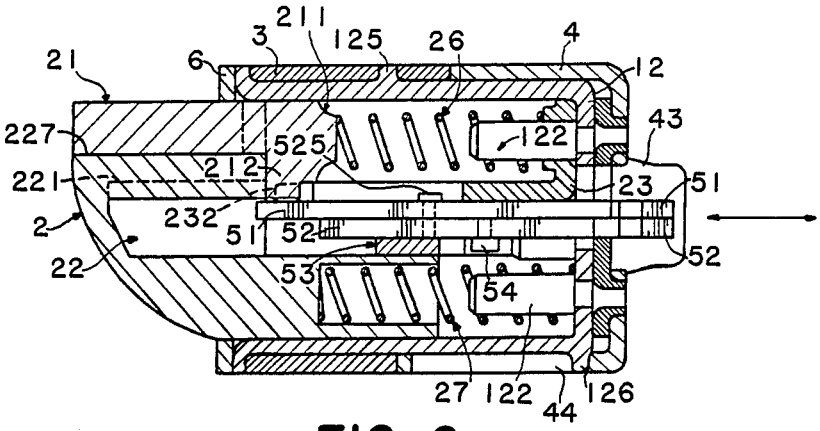
FIG. 6 is a side cross-sectional view of the door lock adjusted to a short size and not locked in the present invention.

FIG. 6 is a side-sectional view similar to FIG. 5, with the dead bolt 2 and anti-burglar bolt 21 extending to their furthermost extent through the plate 6. This corresponds to a position when the door is open, for example, and in this position the tip 232 is seen as lying beneath the plane of the figure where it remains due to the presence of the projection 212. In the position of FIG. 6, the tip 232 can enter the recess 22 since the tip 232 has been resiliently biased toward the enlarged portion of the recess 22 indicated by the dotted line 221. This figure shows the springs 26 and 27 in their extended positions.

Figure 8:
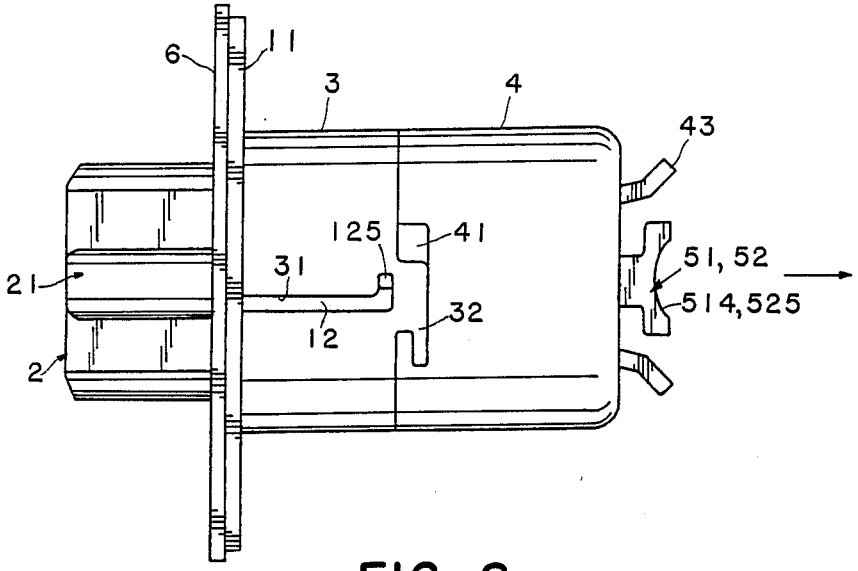
FIG. 8 is a top elevational view of the door lock adjusted to the short size in the present invention.

FIG. 8 is a top elevational view of the assembled lock in a first position which corresponds to a short position of the lock. In this position, the projection 125 of the cylinder 12 is located at the uppermost portion of the L-shaped slot 31. The shells 3 and 4 are interlocked as shown. In the position of this figure, the extending plate 51 has an end 514 which directly overlies the end 525 of the pulling plate 52. Here, force is transmitted to the dead bolt 2 via the pulling plate 52, the overlying extending plate 51 not being capable of transmission of force since, in the short position, the extending plate 51 rides in the slot 523 of the pulling plate 52.

Figure 9:
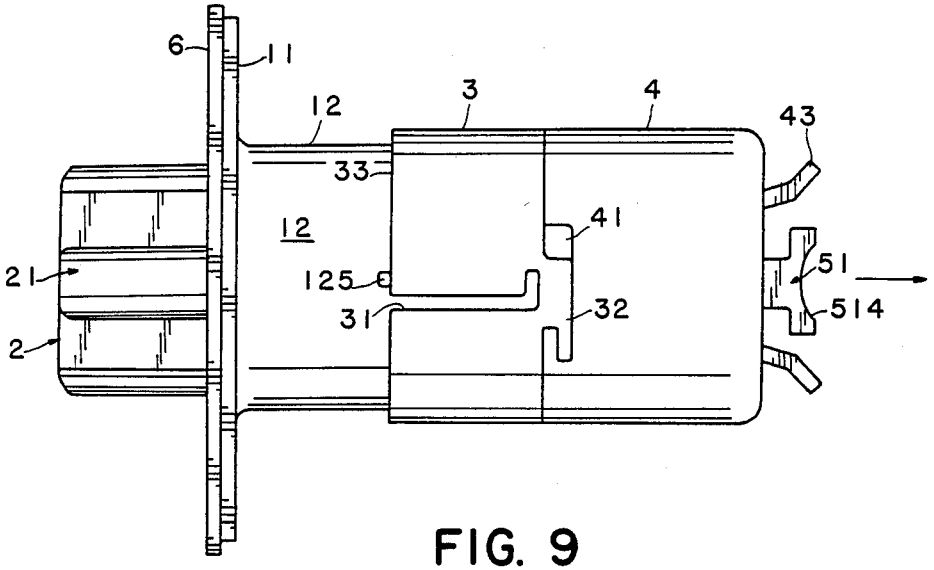
FIG. 9 is a top elevational view of the door lock adjusted to the long size in the present invention.

FIG. 9 shows the extended, or long, position of the trumpet lock of the present invention. Here, the projection 125 abuts the front surface 33 of the rotating shell 3. The projection 125 is not disposed in the slot 31 in this figure. Here, the extending plate 51 has been extended to the right to move along with the extending shell 4. The end 514 of the extending plate 51 no longer overlies the end 525 of the pulling plate 52. Here, since the extending plate 51 is moved relative to the pulling plate 52 such that the rivet 54 abuts the rightmost end of the slot 523, force can be transmitted from the extending plate 51 to the pulling plate 52. The pulling plate 52 in turn causes retraction of the dead bolt 2 when it is actuated in the direction indicated by the arrow in FIG. 9. Pulling to the right of the extending plate 51 causes retraction of the dead bolt 2. As noted hereinabove, retraction of the dead bolt causes retraction of the anti-burglar bolt 21.

Figure 10:
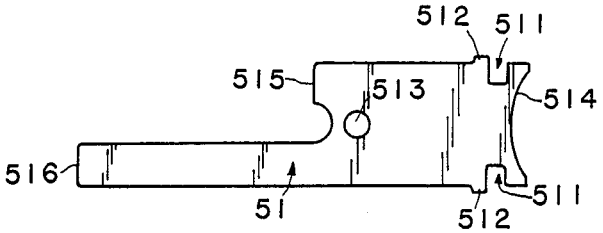
FIG. 10 is a top elevational view of the extending plate in the present invention.

FIG. 10 is a top elevational view of the extending plate 51. The extending plate 51 has an aperture 513, notches 511,511, and a curved end wall 514. Along the left hand portion of the extending plate 51 is an upper end wall 515 which is much shorter than the lower end wall 516. Between the end walls 515, 516 is is a curved portion which corresponds with a slot 523 in the pulling plate 52.

Figure 11:
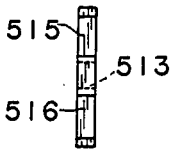
FIG. 11 is a left-hand end elevational view of the plate of FIG. 10.

FIG. 11 is a left hand end elevational view of the extending plate of FIG. 10. In this end view, the aperture 513 is seen in dotted outline, and the end walls 515,516 are seen in their true view.

Figure 12:
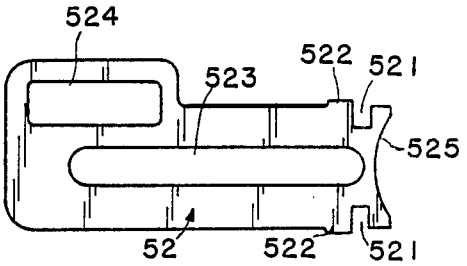
FIG. 12 is a top elevational view of a pulling plate in the present invention.

FIG. 12 is a top elevational view of the pulling plate 52 having an aperture 524 and a slot 523. The pulling plate 52 has a curved end wall 525 and corresponding notches 521,521. Each of the notches 521, 521 has a corresponding soulder portion 522,522.

Figure 13:
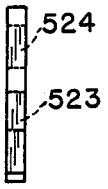
FIG. 13 is a left-hand end elevational view of the plate of FIG. 12.

FIG. 13 is a left hand end elevational view of the pulling plate of FIG. 12. Here, the aperture 524 is seen in dotted outline, as is the slot 523.

Figure 14:
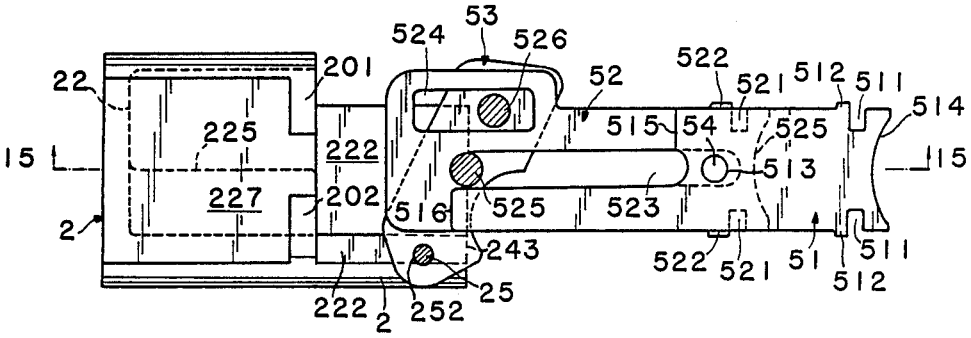
FIG. 14 is a top view of the dead bolt assembled with the extending plate and the pulling plate in this invention.
Figure 15:
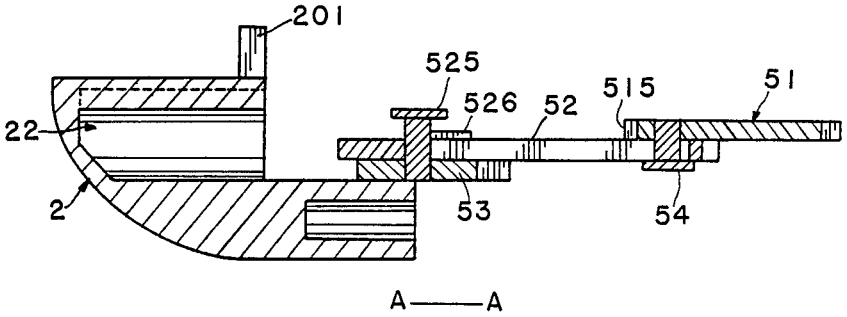
FIG. 15 is a side cross-sectional view of the assembly of FIG. 14.

FIG. 14 is a top elevational view of the assembly of the plates 51, 52, and 53 together with the dead bolt 2. Here, the dead bolt 2 is fixedly connected to the linking plate 53 by the pin 25 which is received within an apeture 252 formed through the surface 222. The pin 25 is shown in section in this figure, as is the rivet 525 and the rivet 526. The end of the rivet 54 is seen in elevational view in FIG. 14.

As seen in FIG. 14, the rivet 54 travels entirely within the slot 523 formed in the pulling plate 52. The rivet 54 is fixedly connected, as by welding, gluing, or by enlargement of the end 54 (customary with rivets) to the extending plate 51 for travel therewith. Thus, the extending plate 51 can travel together with the rivet 54 along the slot 523 of the pulling plate 52. The aperture 524 in the pulling plate 52 permits movement of the rivet 526 relative to the pulling plate 52, so that the linking plate 53, which is fixedly connected to the rivet 526, can pivot.

The slots 511,511 of the extending plate 51 are adapted to be connected with a knob. The two shoulders 512,512 are of a wider width and are used to abut the outside of the bottom 127 of the cylinder 12 so as to keep the slots 511,511 protruding outside the extending shell 4. The opening 126 in the cylinder 12 has a shape adapted to receive the full width of the shoulders 512,512 of the extending plate 51, as well as the shoulders 522,522 of the pulling plate 52. Rotation of the cylinder 12 relative to the plates 51 and 52 causes the shoulders to overlie a narrower portion of the opening 126, i.e., in the orientation of parts as seen in FIG. 1 the shoulders 512 and 522 cannot be withdrawn through the rear wall 127 of the cylinder 12.

The end of the linking plate 53 adjacent to the opening 533 therein, abuts the column 124 of the cylinder 12. This column 124 acts as a fulcrum for the linking plate 53, to pivot about the pin 25 so as to apply a magnified force to the head of the rivet 525 which, as explained hereinabove, acts as a cam to cause movement of the tip 232 of the guarding plate 23.

The assembly of FIG. 1, when fixed together by the face plate 6 against the fixing plate 11, is inserted in a hole formed in a door, bolts, screws, or other threaded members are then inserted in the holes 61,64 and are anchored in the door material so as to secure the face plate 6 to the door.

Figure 16:
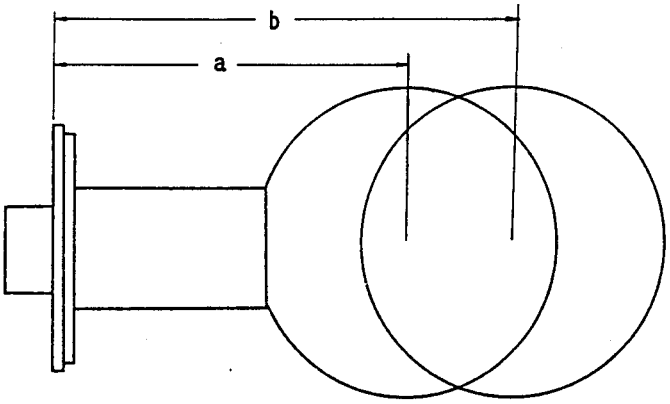
FIG. 16 is the view of the fitting of the door lock on a door in the present invention.

FIG. 16 is a view showing a door lock and round knob (unnumbered) in two positions so as to have a lenth (a) and a length (b).

Figure 17:
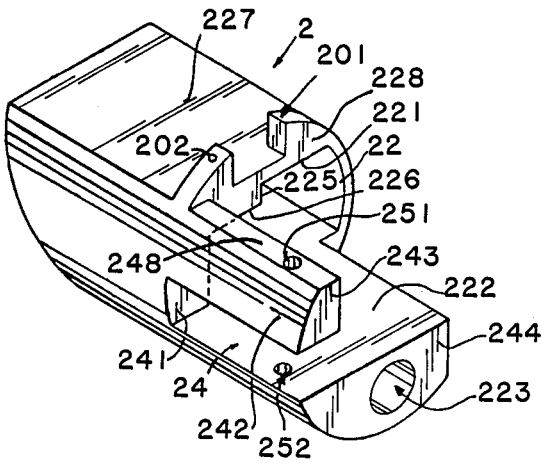
FIG. 17 is a rear perspective view of the dead bolt 2.

FIG. 17 is a perspective rear view of the dead bolt 2. As can be seen, the dead bolt 2 has a top bolt surface 227, a rear abutting surface 228, and a lower ledge 222. The dead bolt 2 has a projecting arm 248 with the bore 251 formed therein. The arm 248 extends over the ledge 222 such that the bore 251 overlies a bore 252 formed in the ledge 222. The arm 248 and ledge 222 define a recess 24 therebetween, the recess 24 being also defined by the wall portion 241. The projection 242 has an upper surface 248 and an end wall 243.

The ledge 222 has an end wall 244. The end wall 244 has a bore 223 formed therein.

Figure 18:
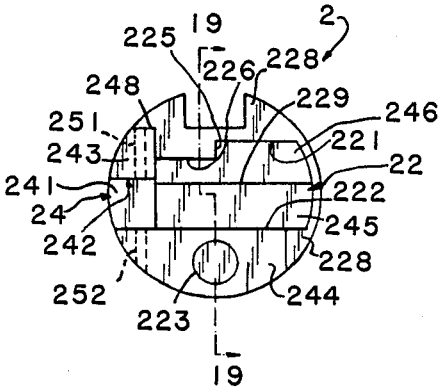
FIG. 18 is an end elevational view of the dead bolt of FIG. 17.

FIG. 18 is a rear elevational view of the bolt 2 of FIG. 17, clearly illustrating the shape of the opening 22 formed in the bolt 2. The opening 22 has a rear surface having an end wall 245 which is connected to an end wall 246 along the line 229. The bores 251 and 252 are seen in dotted outline in FIG. 18. Also, the upper wall 228 of the recess 22 has a descended portion 226 connected to the higher wall 221 by a vertical wall 225.

Figure 19:
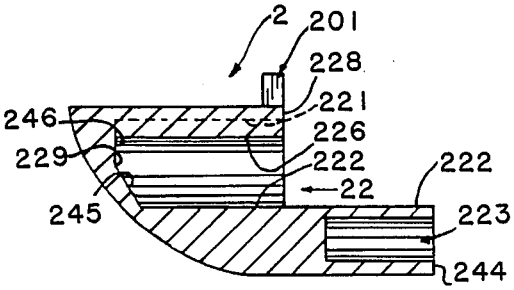
FIG. 19 is a sectional view taken along line 19—19 of FIG. 18.

FIG. 19 is a side sectional view taken along line 19-19 of FIG. 18, and clearly shows the shape of the recess 22 and bore 223. This figure shows the raised portion 201 in side view clearly. The recess 22 as seen in FIG. 19 has a top wall 226 corresponding to the reduced recess size portion, and a top wall 221 (shown in dotted outline in FIG. 19) corresponding to the larger portion of the recess 22 shown in FIGS. 17 and 18.

What is claimed is:

1. A trumpet door lock, comprising:

a base having a fixing plate; a faceplate connected to said fixing plate;

a cylinder fixed to said base such that said base is disposed about one end of said cylinder and extending generally transversely to an axis of said cylinder; said cylinder having at least one guiding projection;

a dead bolt movable into said cylinder; a guarding plate disposed within said cylinder to selectively block movement of said dead bolt into said cylinder; said guarding plate having a tip on a front end thereof; an anti-burglar bolt associated with the dead bolt and movable into the cylinder along with or separately from the dead bolt, the anti-burglar bolt having a projection disposed along a distal portion thereof for selectively positioning said front end of said guarding plate in blocking and non-blocking positions with respect to said dead bolt, the anti-burglar bolt moving the guarding plate from the non-blocking position to the blocking position when the anti-burglar bolt is moved separately into the cylinder;

said dead bolt having an end wall; said end wall having a recess therein, said recess having an internal bounding wall which bounds the extremities of said recess; said end wall of said dead bolt abutting said tip of said guarding plate in said blocking position, and receiving said tip within said recess in said non-blocking position;

said dead bolt having a slot therein, a linking plate disposed on said slot and pivotably connected thereto; said linking plate having an end portion which is pivotably disposed within said slot in said dead bolt;

a rotating shell rotatably disposed about said cylinder, said rotating shell having an L-shaped slot therein for selectively receiving said guiding projection therein for guiding said rotating shell to move axially relative to said cylinder and to guide rotation of said rotating shell concentrically about said cylinder until said guiding projection is in a circumferentially extending limb of said L-shaped slot so as to prevent axial movement of said rotating shell relative to said cylinder; an extending shell non-rotatably disposed about said cylinder and being disposed so as to be axially movable relative to said cylinder; respective cutouts at adjacent ends of the rotating shell and the extending shell which interengage when said guiding projection is in the circumferential limb of the L-shaped slot to prevent axial movement of the extending shell on the cylinder, and which disengage when the rotating shell is rotated to bring the guiding projection into an axially extending limb of the L-shaped slot, thereby permitting movement of the extending shell from a retracted position on the cylinder to an extended position, a plurality of moving accessories within the cylinder and which include an extending plate, a pulling plate and said linking plate;

said extending plate and pulling plate being superposed, the pulling plate being operatively connected with said dead bolt for withdrawing the dead bolt into the cylinder, the extending plate and pulling plate having respective rear end portions extending through apertures in respective back walls of the cylinder and the extending shell, said rear end portions being aligned externally of the extending shell when the extending shell is in the retracted position, said rear end portions being provided with respective slots for connecting both plates together to a door knob when the extending shell is in the retracted position, the extending plate having a lengthwise extending pin-and-slot connection with the pulling plate and side projections which engage the extending shell whereby the extending plate is extended lengthwise over the pulling plate by the extending shell when the extending shell is moved from the retracted position to the extended position and whereby in the extended position said slots at the rear end portion of the extending plate can be connected separately to the door knob for operating the pulling plate to withdraw the dead bolt.

2. The trumpet door lock as claimed in claim 1, wherein said dead bolt is adjacent said anti-burglar bolt; said extending plate has said guarding plate disposed thereover; and a spring is disposed between said anti-burglar bolt and said guarding plate; a projection being disposed at the bottom of said anti-burglar bolt for abutting the front end of said guarding plate;

whereby when said dead bolt is within the door and extends into the locked position in the door frame, said anti-burglar bolt is disposed within said cylinder pushing said top of said guarding plate to slide to the back of said projection and preventing said dead bolt from being pressed to move inwards.

3. The trumpet door lock, as claimed in claim 1, wherein said guarding plate is disposed on top of said extending plate and at the side of a rivet disposed in said slot of said pulling plate.

4. The trumpet door lock as claimed in claim 1, wherein one end of said linking plate is connected with said dead bolt by a pin, the other end leaning on said column of said cylinder, and said rivet from the top of the pulling plate end riveted with the linking plate staying closer to said column, enabling of said pin connected with the dead bolt to swing through a large range of motion.

5. The trumpet door lock as claimed in the claim 1, wherein behind the slots of both said extending plate and said pulling plate there are shoulders used to keep the slots extending outside the bottom of said cylinder.

* * * * *